United States Patent [19]

Shalev

[11] Patent Number: 4,619,184

[45] Date of Patent: Oct. 28, 1986

[54] GAS ACTUATED PISTOL

[75] Inventor: Ilan Shalev, Givataim, Israel

[73] Assignee: The State of Israel Ministry of Defense, Military Industries, Ramat-Hasharon, Israel

[21] Appl. No.: 810,549

[22] Filed: Dec. 19, 1985

Related U.S. Application Data

[63] Continuation of Ser. No. 555,334, Nov. 28, 1983, abandoned.

[51] Int. Cl.[4] ..... F41C 5/02

[52] U.S. Cl. ..... 89/185; 89/191.01; 89/199

[58] Field of Search ..... 42/75 L; 89/185, 191.01, 89/191.02, 196, 199

[56] References Cited

U.S. PATENT DOCUMENTS

| | | | |
|---|---|---|---|
| 900,865 | 10/1908 | Louis | 89/196 |
| 1,028,032 | 5/1912 | Krag | 89/196 |
| 1,047,671 | 12/1912 | Mauser | 89/196 |
| 1,735,160 | 11/1929 | Destree | 89/191.01 |
| 2,655,839 | 10/1953 | Ruger | 42/75 C |
| 2,865,256 | 12/1958 | Marsh | 89/191.01 |
| 3,069,976 | 12/1962 | Stevens | 89/196 |
| 3,166,983 | 1/1965 | Lizza | 89/191.01 |
| 3,306,168 | 2/1967 | Blumrick | 89/196 |
| 3,618,457 | 11/1971 | Miller | 89/185 |
| 3,657,960 | 4/1972 | Badali | 89/191.02 |
| 4,563,937 | 1/1986 | White | 89/185 |

FOREIGN PATENT DOCUMENTS

| | | | |
|---|---|---|---|
| 453658 | 12/1927 | Fed. Rep. of Germany | 89/191.01 |
| 251151 | 7/1948 | Switzerland | 89/191.01 |
| 1601 | of 1907 | United Kingdom | 89/196 |

OTHER PUBLICATIONS

George M. Chinn, The Machine Gun, 1951, p. 406.
Rheinmetall, Handbook on Weaponry, 1982, p. 288.

*Primary Examiner*—Stephen C. Bentley
*Attorney, Agent, or Firm*—Browdy and Neimark

[57] ABSTRACT

A fully gas operated pistol includes a frame unit, a barrel unit, a bolt carrier unit slidably supported on the frame unit and a spring which urges the bolt carrier unit into a forward, bolting position. A path links the breech end of the barrel with a rearward pointing cavity near the muzzle end of the barrel. The cavity is adapted to accommodate a piston of the bolt carrier unit. Gases expanding upon the firing of a bullet expand under pressure into the piston accommodating cavity, thus causing the bolt carrier unit to retract.

5 Claims, 8 Drawing Figures

GAS ACTUATED PISTOL

This application is a continuation of application Ser. No. 555,334 filed Nov. 28, 1983, now abandoned.

BACKGROUND OF THE INVENTION

1. Field of the Invention

The present invention generally relates to firearms and, more particularly, to gas actuated pistols.

2. Description of the Prior Art

Firearms which utilize for their operation gases which expand therein as a result of burnt propellants are known. The expanding gases are used to cause a slide to move aft for automatic or semi-automatic operation. Among such firearms are pistols, such as the one disclosed in U.S Pat. No. 3,657,960. The known pistols which utilize expanding gas, i.e. gas actuated firearms, include many parts and thus are complicated, difficult to take apart and reassemble, for cleaning or repairing. They are also quite expensive. In addition they are not believed to provide sufficiently high accuracy and reliability. Furthermore they are not designed nor capable of use with reassembling large caliber ammunition such as 0.357 or 0.440 ammo.

All of the known disadvantages of prior art gas operated pistols are believed to be overcome by the novel pistol of the present invention, which is gas actuated. The novel pistol of the present invention can be thought of as comprising:

a frame unit having a front section and a rear section, said front and rear sections terminating in fore and aft ends respectively, said front section being trough shaped defining a pair of spaced apart side walls and a bottom side for forming the bottom of said trough and interconnecting said side walls;

a barrel unit releasably lockable to said frame unit, comprising a barrel defining a bore for a bullet to pass therethrough, said bore having muzzle and breech ends, and front and rear locking members, for engaging said frame unit and be lockable to the front section thereof, said barrel defining a path for gases having one end in communication with said bore proximate the breech end thereof, and extending along said barrel and a second end in communication with an elongated cavity defined in said front locking member, said cavity extending inwardly from an open end in a direction toward the fore end of said barrel unit;

a slidable unit slidable on said frame unit, said slidable unit including a front section shaped to slide under said barrel unit when the latter is locked to said frame unit, and an aft bolt-receiving section, and pressure responsive means at the fore end of said front section adapted to respond to gas pressures in said cavity for applying a force in the aft direction to cause said slide unit to slide aft; and bias means in contact with said frame and slide units, for applying a fore pressure to said slide unit to urge it toward the front locking member of said frame unit.

As will be described hereafter in detail the front locking member, in addition to the cavity, is shaped so as to wrap around the fore end of the frame unit for added secure interlocking between the barrel and the frame unit. As to the slide unit, it includes a uniquely shaped bridge member which bridges the two slide walls on which the unit slides. The top side of the bridge member is curve-shaped to accommodate the bottom round surface of the barrel so that the slide can slide under it.

The bridge member also has a short downwardly pointing bar which is designed to engage a crossbar of a unique biasing unit. The crossbar is slidably supported on two rods on which specially designed coil springs are supported. A specially shaped piston extends fore of the bridge member into the cavity of the front locking member to be subjected to gas pressures therein and to apply an axial force in the aft direction to the bridge member and thus to the entire slide unit which in spite of the spring bias slides aft.

A uniquely shaped bolt which is supported by the slide unit is included.

A novel hammer-driving unit formed as a kit which is releasably securable to the frame unit is included. By means of the hammer-driving unit the length and pressure of the trigger of a two-stage trigger system can be adjusted. Furthermore, the pistol includes a unique arrangement whereby the safety catch provides double safety in that it immobilizes the firing pin as well as disconnects the trigger from the hammer driving unit at the same time.

The novel features of the invention are set forth with particularity in the appended claims. The invention will best be understood from the following description when read in conjunction with the accompanying drawings.

Figure 1:
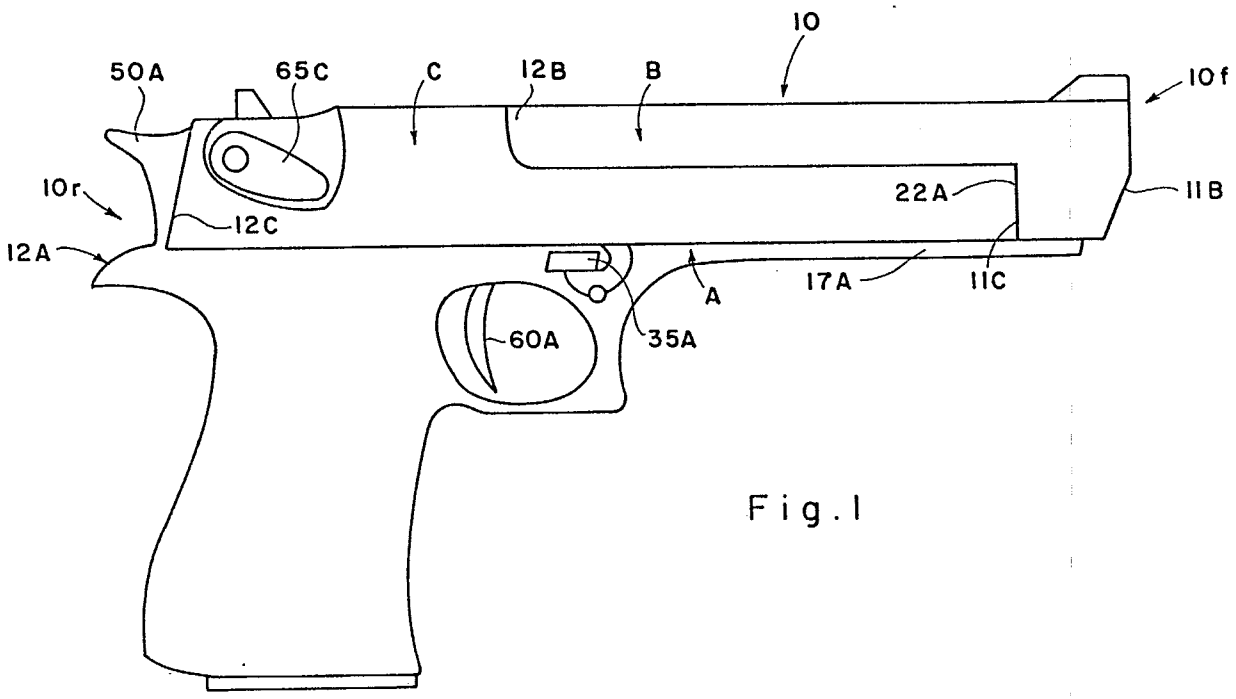
FIG. 1 is a side view of the novel pistol.

Attention is first directed to FIGS. 1–4 in connection with which the novel gas actuated pistol of the present invention will first be described. The pistol 10 is made up of three basic major units or parts. They include a frame unit or simply frame A, a barrel unit or simply barrel B and a slidable unit or simply slide C. It further includes other parts which will be described in detail. The latter, whether forming an integral part of one of the major units or attached or supportable thereon, will generally be designated by a numeral followed by the letter of the unit, with which it is associated, as a suffix. As will become apparent from the following description of the pistol 10, its frame A, slide C and barrel B are easily assembled and disassembled for maintenance or repair. In FIG. 1 the pistol is shown fully assembled. The figure represents a side view of the pistol with its front or fore end through which a bullet or slug exits designated by 10*f* and its rear or aft end by 10*r*.

The fore and aft ends of each of frame A, barrel B and slide C are designated by the numerals 11 and 12, respectively, followed by the unit's designation letter, e.g. 11A and 12A, 11B and 12B and 11C and 12C. In FIG. 1 the pistol 10 is shown with slide C in its fore position.

Figure 2:
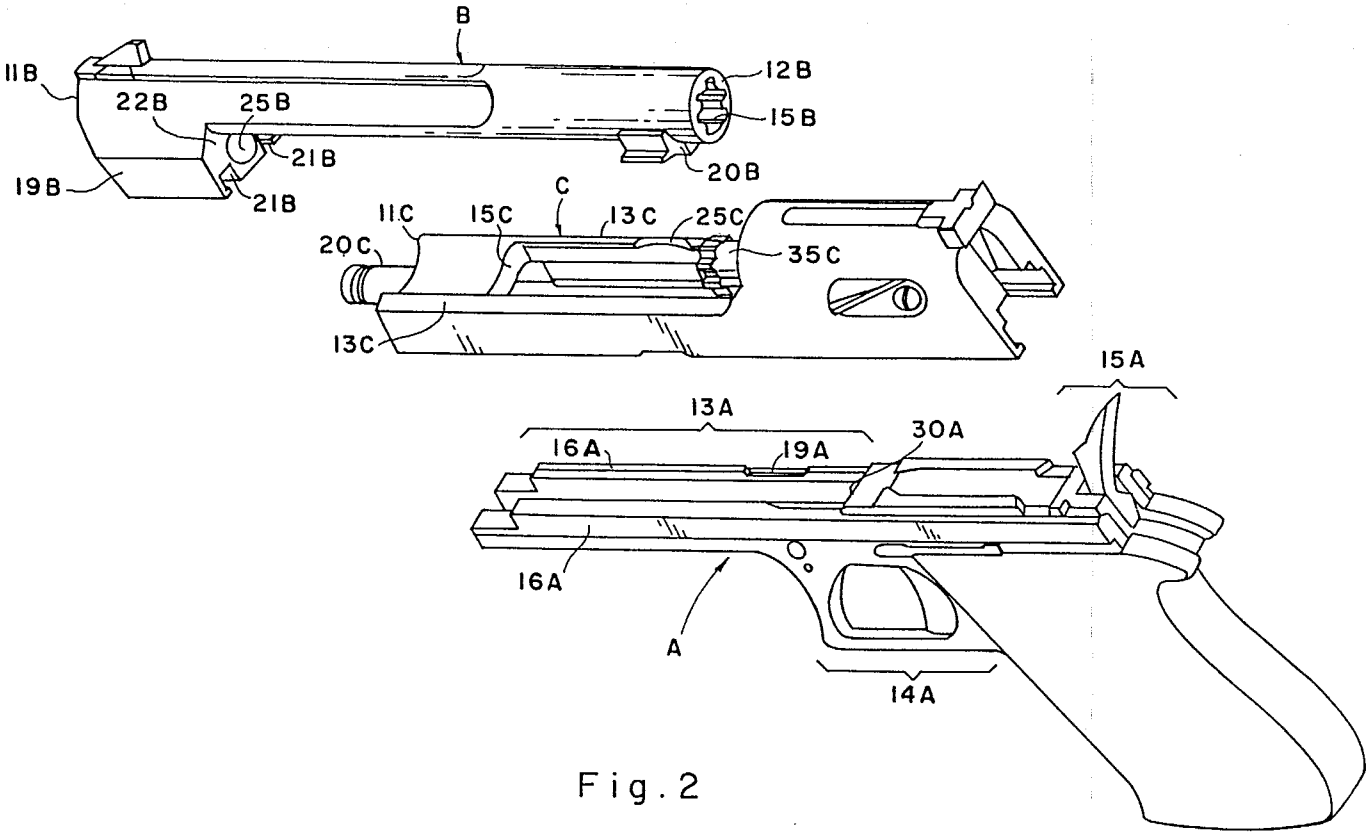
FIG. 2 is an expanded isometric view of a major part thereof.

As shown in FIG. 2, the frame A is designated as having a barrel-accommodating section 13A, a trigger section 14A and a hammer unit-accommodating section 15A. Section 13A is trough or U-shaped in cross-section and is formed by the vertical spaced apart side walls 16A which are joined together by a base 17A (see FIG. 1). Elongated grooves 19A are formed in the side walls 16A for facilitating the locking of the aft end 12B of the barrel B to frame A. As shown, the barrel unit B has an axial bore 15B extending from the barrel's fore end 11B which represents the bore's muzzle end, to aft end 12B, representing the bore's breech end. Barrel B further includes front and rear barrel locking members 19B and 20B at the fore end 11B and proximate aft end 12B, respectively. It is by means of these members that barrel B is releasably lockable to frame A through slide C. As will be described hereafter in detail in connection with FIG. 3, barrel B defines a unique path for gases produced at the bore's breach end through the barrel and through front locking member 19B, which provides the novel pistol with some of its unique advantages.

The front locking member 19B can be viewed of as a block which represents the fore section of the pistol with a front side or face representing fore end 11B and an opposite side 22B against which the fore end 11C of the slice C is biased, as will be described. Member 19B is uniquely shaped in that it defines two symmetrical cavities 21B which extend inwardly from side 22B. They are shaped and spaced apart to accommodate therein the fore ends of side walls 16A of frame A, while the fore end of the bottom 17A of the frame side is accommodated in a recess under side 22B. (See FIG. 1). Thus, when the barrel B is locked to frame A, the front or fore end 11A of the frame is accommodated in front locking member 19B. The latter effectively is wrapped around the frame fore end 11*a*, thereby enhancing the fore interlocking of the two units for enhanced pistol performance.

Figure 3:
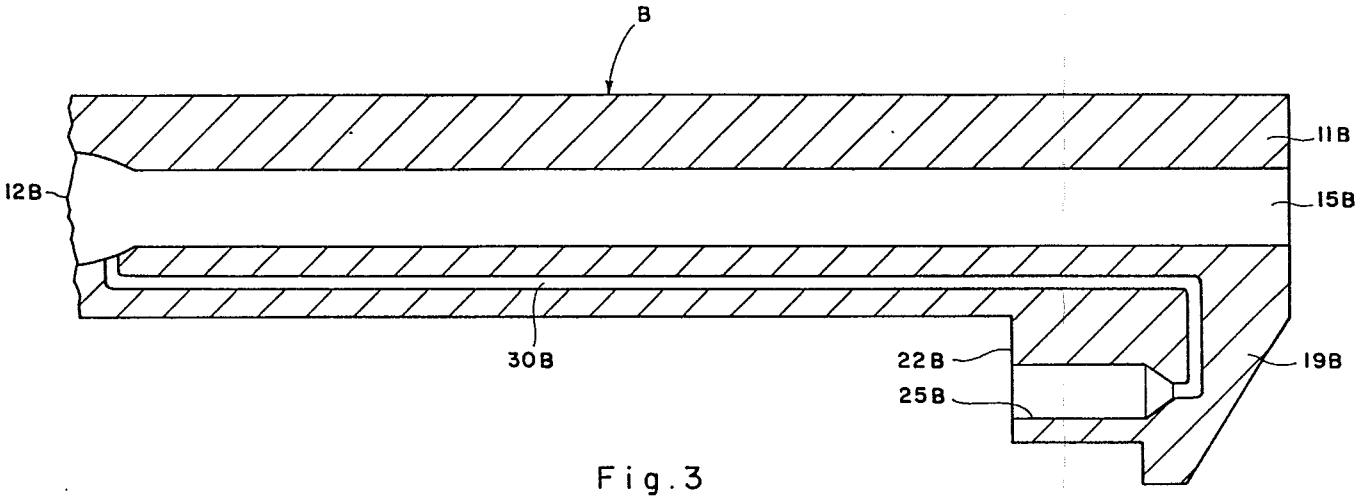
FIG. 3 is a cross-sectional view of the novel barrel.

In addition to cavities 21B in member 19B, an axial cavity 25B is formed therein. (See FIGS. 2 and 3). The cavity extends inwardly from face 22B. The purpose of this cavity may best be explained in connection with FIGS. 2–5. FIG. 3 is essentially a partial cross-sectional view of barrel B. As shown therein, in addition to bore 16B formed therein, a cavity or path 30B is formed. It extends from the breech end 12B, then below and along the bore 16B but spaced therefrom and up to the bottom end of cavity 25B. As is known, when a bullet is fired the burned propellants produce gases at high pressure. In the present invention these gases are made to travel along path 30B and exit through cavity 25B. It is the pressure of these gases which is used to push the slide C aft against a bias force provided by an arrangement which will be described.

Figure 4:
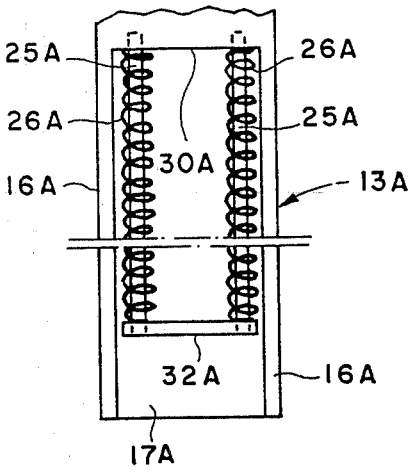
FIGS. 4 and 5 are partial views useful in explaining significant features of the invention.

Briefly, in section 13A of frame A, a spring biasing assembly is located as shown in FIG. 4. It is located in the U-shaped trough of section 13A. It consists of two rods 25A on which springs 26A are wound. The aft ends of rods 25A are in appropriate grooves in wall 30A of the frame A while their other ends are supported on a horizontal plate 32A which is slidable on the rods.

Figure 5:
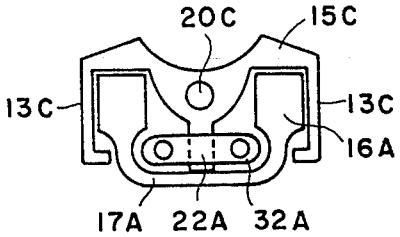

Attention is now directed to FIGS. 1 and 5. FIG. 5 is an end view of slide C on frame A. As shown, the fore end of 11C of slide C is shaped with a bridge-like member 15C which forms a bridge between side walls 13C of the slide. The top of the bridge member 15C is curved to accommodate the barrel B thereon. Extending from member 15C is a cylindrical post 20C. It is this post or piston which is accommodated in cavity 25B of the front locking member 19B. In addition, extending downwardly from bridge member 15C below piston 20C is a protrusion-like member or short bar 22C. It is bar 22C which presses against horizontal plate 32A. The bar does not extend over the entire width of the bridge as viewed in the fore to aft direction.

The slide C has appropriate grooves 25C shaped in its opposite sides 13C (see FIG. 2) to facilitate the insertion of rear locking member 20B of barrel B into frame A. The locking member 20B is inserted through grooves 25C in the slide and grooves 19A in the frame when the grooves are aligned and thereafter the front locking member 19B is positioned to accommodate the fore ends of sides 16A into openings 21B. Then the rear locking member 20B is locked in position with its aft side pressing against wall 30A and its fore side engaging a locking cam which is operable by turning a lever 35A (see FIG. 1). It should be appreciated that different arrangements may be employed to insert the aft end 12 of barrel B through slide C and lock it therein.

In the assembled position, as shown in FIG. 1, the barrel B is locked to the frame A. As to the slide C, it is biased fore by springs 26A pushing the plate 32A fore. It pushes arm 22C (FIG. 5) fore and thus urges the slide C forward. In the assembled position the fore end 11C of the slide abuts the rear wall 22B of the front locking member 19B, and the piston 20C is inside axial cavity 25B. In this position the slide C is biased fore by the springs 26A.

When a bullet is fired gases are created by the burning propellants at the breech end 12B of barrel B. Due to the high gas pressure the bullet or slug is propelled out of the bore. In accordance with the present invention, as shown in FIG. 3 and as previously explained, gas path 30B is provided in the barrel. This path starts at the breech end whereat the gas pressure is very high and ends in axial cavity 25B. Thus high pressure is produced thereat. Since piston 20C of the slide C is present in the cavity, it is subjected to the high pressure and as a result it is pushed axially out of the cavity 25B in the aft direction. Since the piston 20C is part of the bridge member 15C which in turn is part of the slide C, the entire slide is pushed aft against the bias forces of the springs which urge it forward.

By using the pressure of the gases at the breech end to drive the axial slide back, very improved performance is attained.

As the slide C travels aft, the spent case in the breech end is extracted and the hammer 50A is cocked. Once the gas force is less than that applied by the springs, the slide C moves fore, during which a new cartridge is extracted from the magazine and is inserted into the breach end. Finally, the slide C returns to its most fore position and the pistol with the cocked hammer is ready to be fired again.

Figure 6:
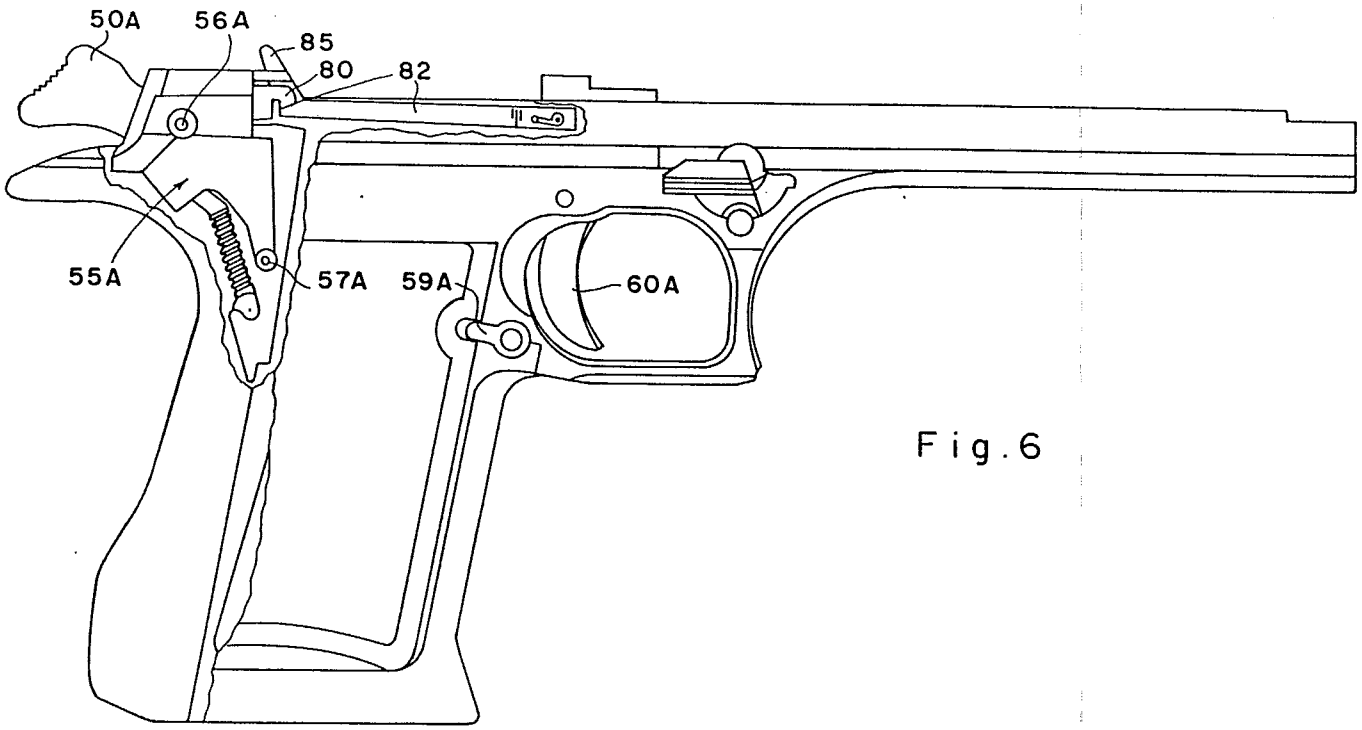
FIG. 6 is a combination side cross-sectional view of the pistol.

Attention is now directed to FIG. 6 which is a combination side view of the fore section of frame A and an isometric view of the aft section. Therein the hammer 50A is shown in the cocked position below a safety grip. As will be pointed out hereafter the hammer forms part of an easily removable hammer unit 55A. The entire hammer unit is held in position by two pins 56A and 57A which can be removed to repair or replace the hammer unit. Pin 57A is generally covered by a cover or held grip on the frame of the pistol handle in which a magazine is typically inserted. Numeral 59A designates the magazine latch.

As shown in FIG. 6 a sear lever 80 extends from the hammer unit. It is essentially hook-shaped. Its function is to engage a trigger bar 82 which is in turn controlled by the pistol trigger 60A.

The cocking of the hammer pulls the sear lever aft. It in turn pulls the trigger bar 82 aft and the trigger is pulled forward. By pressing the trigger the trigger bar 82 is pulled forward, pulling with it the sear lever. When pulled forward sufficiently the spring holding the cocked hammer is released and the hammer is driven to strike the firing pin (not shown).

As shown in FIG. 6, the trigger bar 82 has a pair of ears 85 (one being shown). When the safety catch 65C (see FIG. 1) is turned to the safety position, inside slide C a cam presses on these ears 85. As a result, the trigger bar 82 is pressed down, clearing the sear lever 80. Thus, pressing on the trigger causes the trigger bar to move without engaging the sear lever.

Figure 7:
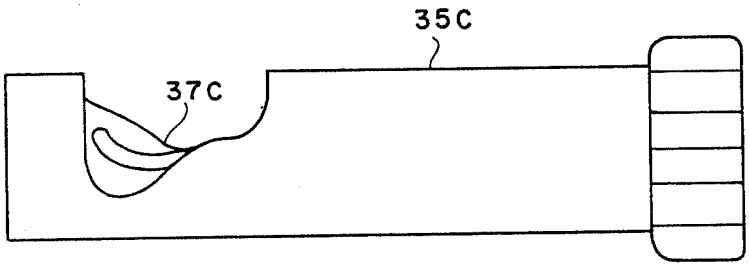
FIG. 7 is a side view of a novel bolt.

As shown in FIG. 1, at the breech end 12B of bore 16B locking lugs are shown. They are designed to cooperate with the locking lugs of a bolt 35C in slide C. That is, the pistol is of the locking type. Since the slide C moves axially with respect to barrel B the bolt 35C, in addition to moving axially with the slide has to rotate somewhat to enable its locking lugs to interact with those of the barrel B. The bolt is typically in the shape of an elongated cylinder with the lugs at one end thereof. Herebefore the bolt has been shaped with a cavity having a compound helical shape and extending through the center of the bolt. A pin is fixedly positioned in a direction transverse to the bolt's central axis. Although such an arrangement operates satisfactorily the bolt is undesirably weakened. In accordance with the present invention as shown in FIG. 7, a bolt 35C is provided which has a cavity 37C extending inwardly from the bolt's periphery. The cavity is shaped so that as the bolt 35C moves axially against a stationary pin a rotational motion is imparted to the bolt. By forming cavity 37C from the bolt periphery the bolt is much more reliable and has a much longer lifetime than prior art rotational bolts. The novel bolt can be thought of as a bolt with a peripherally extending cavity to impart to it a rotary motion as it moves linearly by a stationary pin, engaged in the cavity.

Figure 8:
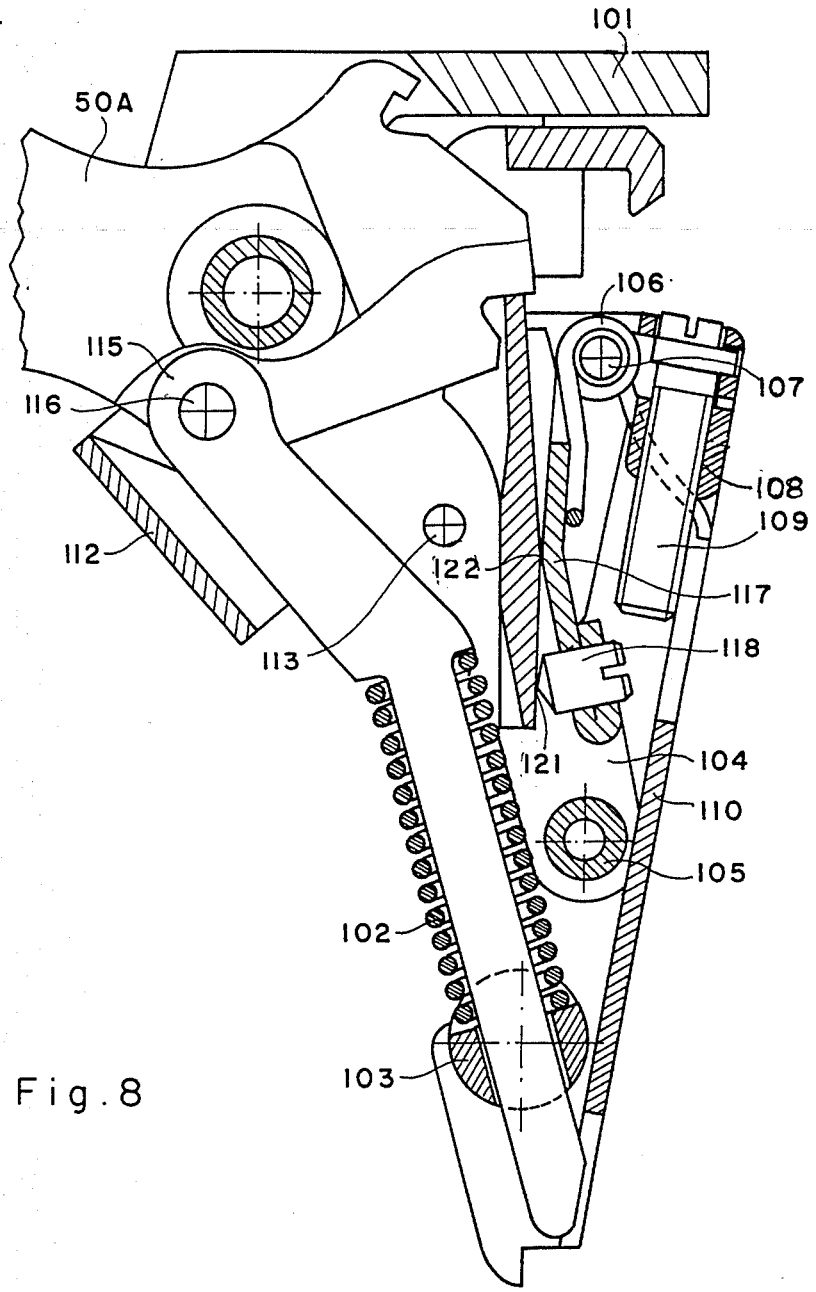
FIG. 8 is a combination cross-sectional block view of a novel hammer unit.

As previously pointed out the trigger unit can be easily removed. In accordance with another aspect of the present invention an adjustable two-stage trigger unit is provided. Both length and pressure of the trigger pull can be adjusted to suit the needs of the individual marksman. Such a unit is shown in FIG. 8. Therein numerals 101 - 104 respectively, designate the unit housing, the spring for hammer, a hammer spring support, and a member forming part of the sear lever, which can pivot about 105. Numeral 106 designates a spring which is used to control the trigger pull pressure, while 107 designates a pin about which spring 106 is wound. Numeral 108 designates a nut-like element against which one end of spring 106 presses, while 109 designates a pressure adjustment bolt. Numeral 110 designates the unit housing, while 112 designates a safety cover. An assembly pin 113 is also shown. The hammer post is designated by 115 and its pivot by 116. Finally, a trigger length control bar is shown as 117 and a trigger length bolt adjuster by 118.

As seen, the heads of bolts 109 and 118 are accessible from the outside. By turning bolt 109 farther in more pressure of trigger pull is required to pull the sear lever to the right (as shown). As to trigger length it is controlled by bolt 118. When bolt 118 is turned in and contact is formed between its tip and the sear lever element, the contact point being designated by 121, one length of the trigger pull is established. Otherwise a different length exists as a function of the contact point 122.

Although particular embodiments of the invention have been described and illustrated herein, it is recognized that modifications and variations may readily occur to those skilled in the art and consequently, it is intended that the claims be interpreted to cover such modifications and equivalents.

I claim:

1. In a fully gas operated pistol including:

a frame unit defining first and second sections extending to the front and rear ends thereof, respectively;

a barrel unit defining an axial bore with muzzle and breech ends and front and rear locking means fixedly receivable by said frame unit at the front and rear ends thereof;

a bolt carrier unit intermediary between said frame and barrel unit, slidably supported on said frame unit and slidable between said front and rear locking means of the barrel unit and including a forward, barrel receiving section and a rear, bolt receiving section, said forward section including a bridge-like member connecting two opposite walls of the bolt carrier unit;

biasing means having a first end in contact with said frame unit and a second end in contact with said bridge-like member for urging the bolt crarier unit forward, the improvement wherein:

(i) said bolt carrier unit comprises a piston extending forwrad from said bridge-like member;

(ii) said barrel unit comprises, near the muzzle end, a rearward facing cavity to accommodate said piston of the bolt carrier unit, said cavity being hereinafter referred to as the piston accommodating cavity;

(iii) said barrel unit further comprises a passage linking the breech end of said axial bore with said piston accommodation cavity, said passage being distinct and separate from said axial bore which passes comprises an intake port near the breech end of the barrel, a main section extending in parallel to the barrel and essentially coextensive therewith and a delivery section designed for injecting propellant gas into said cavity to expand rearward therein;

(iv) the arrangement being such that gases expanding from the breech end of the barrel unit is consequence of a bullet being fired expand under pressure to said piston accommodating cavity whereby the bolt carrier unit is forced against the action of said biasing means from a first, forward position in which said piston extends into the piston accommodating cavity, to a second, retracted position; and after the emergence of the bullet from the muzzle and the consequential full expansion of the gases, the bolt carrier unit is urged by said biasing means back into said first position.

2. A fully gas operated pistol as recited in claim 1 wherein said front locking means of said barrel assembly further include recesses therein for accommodating therein at least two vertical side walls of the front end of said frame unit.

3. A fully gas operated pistol as recited in claim 2 wherein said biasing means comprises a pair of spaced apart springs disposed around spring guides, and disposed beneath said barrel.

4. A fully gas operated pistol as recited in claim 1 wherein said biasing means comprises a pair of spaced apart springs disposed around spring guides, and disposed beneath said barrel.

5. A fully gas operated pistol as recited in claim 3 wherein said biasing means further comprises a bar element slidable on said spring guides and said bridge-like means includes a tongue-like element whereby as force is applied to said piston to cause the bolt carrier unit to slide aft, said tongue-like element pushes said bar element aft on said spring guides thereby compressing the spaced apart springs.

* * * * *

UNITED STATES PATENT AND TRADEMARK OFFICE

CERTIFICATE OF CORRECTION

PATENT NO. : 4,619,184

DATED : October 28, 1986

INVENTOR(S) : Ilan SHALEV

It is certified that error appears in the above-identified patent and that said Letters Patent is hereby corrected as shown below:

On the Title Page:

Correct item 73, Assignee to read as follows:

[73] Assignee: The State of Israel
Ministry of Defence
Israel Military Industries
Ramat-Hasharon, Israel

Signed and Sealed this

Twenty-fourth Day of February, 1987

*Attest:*

DONALD J. QUIGG

*Attesting Officer* *Commissioner of Patents and Trademarks*